United States Patent [19]

Wueger

[11] 4,300,599

[45] Nov. 17, 1981

[54] WARP DETECTION SYSTEM

[75] Inventor: Karl W. Wueger, Wakefield, R.I.

[73] Assignee: Leesona Corporation, Warwick, R.I.

[21] Appl. No.: 109,602

[22] Filed: Jan. 4, 1980

[51] Int. Cl.[3] ..... D03D 51/20; G01N 21/18

[52] U.S. Cl. ..... 139/352; 139/353; 356/429; 250/571; 66/163

[58] Field of Search ..... 139/349, 350, 352, 353, 139/369; 66/163; 356/429; 250/571, 216

[56] References Cited

U.S. PATENT DOCUMENTS

| | | | |
|---|---|---|---|
| 2,438,365 | 3/1948 | Hepp et al. | 139/353 |
| 2,884,017 | 4/1959 | Jenkel | 139/350 |
| 3,530,690 | 9/1970 | Nickell et al. | 66/163 |
| 3,575,515 | 4/1971 | Fertig | 66/163 |
| 3,738,124 | 6/1973 | Reynolds | 66/163 |

FOREIGN PATENT DOCUMENTS

| | | | |
|---|---|---|---|
| 47-35637 | 9/1972 | Japan | 139/353 |

*Primary Examiner*—Henry Jaudon
*Attorney, Agent, or Firm*—Burnett W. Norton

[57] ABSTRACT

Loss of tension in individual warp threads is detected in the lease zone by directing a flow of air against one side of the warp threads within the lease zone to displace any relatively untensioned thread toward the opposite side of said zone and detecting such displacement photoelectrically. Preferably, the photoelectric detector is insensitive to disturbances other than thread displacement.

8 Claims, 6 Drawing Figures

WARP DETECTION SYSTEM

FIELD OF THE INVENTION

This invention relates to the art of weaving and is concerned more specifically with an improved system for detecting the loss of tension in any warp yarn being delivered to a weaving machine or loom.

BACKGROUND OF THE INVENTION AND DISCUSSION OF PRIOR ART

Modern looms conventionally include so-called drop wires for detecting the breakage or other loss of tension in individual warp threads being delivered to the loom for weaving with transversely inserted filling threads. Typically, the drop wires take the form of elongated wires or thin plates having an aperture or other means for engagement thereby of an individual warp thread. These drop wires essentially hang loosely upon the individual warp threads and upon the loss of tension therein slip or fall downwardly under the influence of gravity to complete an electrical circuit providing an indication of the occurrence of a break or other disturbance in the normal tensioned condition of that thread which if allowed to go uncorrected would result in the creation of a perceptible defect in the ultimately woven fabric when the thread discontinuity finally reaches the weaving zone. In addition, the occurrence of a break or extensive slack in the warp yarns can result in more or less serious entanglement of the loose or broken end of the thread with adjacent warp threads so as to impede the passage of such entangled threads through the harness motion, leading in serious cases to damage to the harness motion or other major problems. In the usual arrangement, the output signal from the drop wire detector serves to automatically halt the weaving operation by activating a so-called loom stop motion. While the drop wire arrangement is generally effective to detect warp thread breakage and the like, such wires are necessarily in physical engagement with each individual thread and while they can be constructed of thin lightweight material, there nevertheless results some consequential abrasion upon the threads which may be undesirable especially in the case of very delicate threads and the like. Aside from the aspect of possible thread wear, the drop wire arrangement is in any case inconvenient since each warp thread must be manipulated individually into engagement with the corresponding drop wire which significantly increases the difficulty of and time required for threading up of the warp in the loom preparatory to the beginning of weaving.

According to a description of the prior art appearing in U.S. Pat. No. 3,902,534, it has been previously proposed in the art to provide photoelectric detection means projecting adjacent the underside of the warp for detecting the passage of a broken thread across the light beam thereof under the influence of gravity so as to avoid the necessity for physical contact with the warp threads themselves. However, the patent explains that since the warp threads are under a significant amount of tension, particularly when the harnesses of the harness motion are in maximum separated position to form the warp shed for insertion of the filling thread therethrough, the breakage of a thread may well result in the thread entangled with adjacent warp threads and thereby precluded from falling under the force of gravity into the path of the photoelectric beam and to provide a more positive mode of detection, this patent combines with the photoelectric thread detection means a wire brush or comb which wipes against the warp array across the width thereof at a locus spaced from the photoelectric beam so as to engage and entrap the end of any broken or loose warp thread and upon continued rotation of the brush or comb, positively draw the thus-engaged thread across the path of the photoelectric beam to intercept the same and activate the photoelectric receiving element. As an alternative to the photoelectric detector, other kinds of thread detectors can be substituted such as a wire extending across the warp and connected to a sensitive microswitch to sense the presence of any warp thread deviated from the normal warp path by engagement with the wiping element.

This combination while perhaps avoiding the problem inherent in any detection system dependent upon the action of gravity to displace the thread to be detected obviously achieves this improvement at the price of physical engagement of the threads by the wiping brush or comb with the consequential re-creation of the same basic problem as that accompanying the use of lease rods which the photoelectric approach endeavored to eliminate.

Therefore, the objective of achieving positive reliable warp thread detection without the necessity for any physical contact with the warp threads themselves remain unachieved in this art.

OBJECTS OF THE INVENTION

It is, therefore, the primary object to provide a warp detection system capable of positive reliable detection of any broken or relatively untensioned warp thread without making physical contact of any kind with any of the warp threads.

A further object of the invention is an improved warp detection system utilizing a current or flow of air impinging against a portion of the warp thread array generally within the lease zone of the loom in which the warp threads undergo a perceptible inflection combined with photoelectric detecting means extending across the opposite side of the warp thread array in the lease zone for detecting the interception thereby of any broken or relatively untensioned warp thread displaced by the air current or flow.

Another object of the invention is the creation of a pulsating air flow impinging upon the warp array in the lease zone for imposing an oscillating motion upon any broken or loose thread to facilitate its detection by photoelectric detecting means.

BRIEF DESCRIPTION OF THE DRAWINGS

These and other objects of the invention will be more readily and fully understood from the following detailed description when read in conjunction with the accompanying drawings in which.

DETAILED DESCRIPTION OF THE INVENTION

Figure 1:
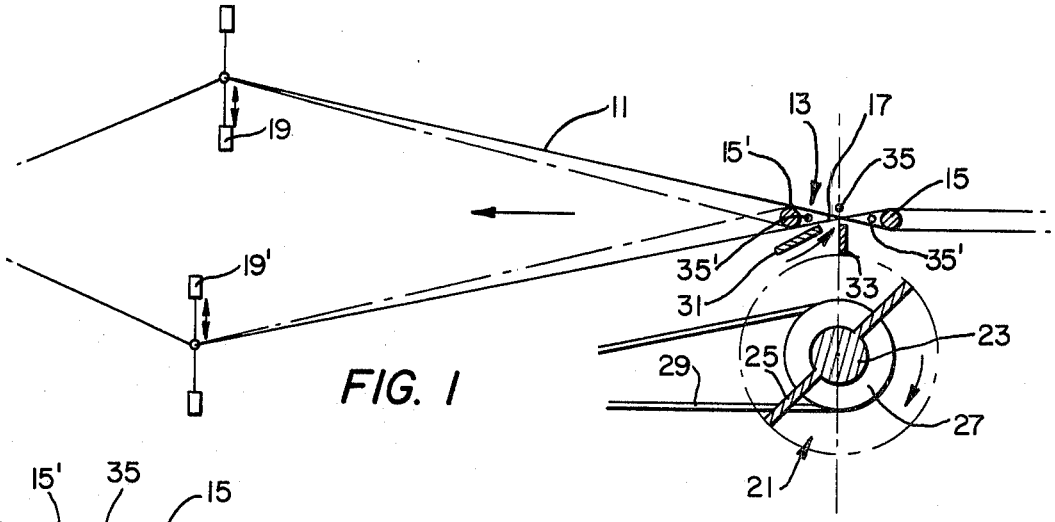
FIG. 1 is a diagrammatic side elevation of the shedding zone of a loom incorporating one embodiment of the warp detecting system of the present invention.

Referring now to FIG. 1 there is shown fragmentarily there just enough of a typical loom as to establish a context for a detailed description of one embodiment of the present invention. In FIG. 1, the numeral 11 designates a generally planar array of warp threads delivered from a conventional source of such threads, such as a warp beam or a warp creel, the details of which and their related operating mechanisms, i.e., warp let-off and the like, have no connection with the present invention and are hence omitted. The warp thread array 11 passes through a leasing zone generally designated 13 which is formed by a pair of lease rods 15 and 15′ which are spaced apart from one another in the direction of warp array. Typically, the leasing rods are approximately ½ to ¾ inch in diameter and are spaced apart roughly 3 to 6 inches and the limits of the leasing zone are defined generally by the upstream and downstream extremities of the lease rod pair. In the leasing zone 13, one-half of the threads in the warp array pass above the upstream rod 15′ and beneath the downstream rod 15, while the other half of the warp threads pass beneath the upstream rod 15′ and above the downstream 15 so as to form a lease cross point 17 defined by the intersection of the two groups of threads substantially at the median point between the lease rod pair. The threads in the two groups are interspersed usually in alternating relation to one another.

Downstream of lease zone 13, the warp threads pass to the heddles of the heddle or shedding motion, two of which are shown in FIG. 1 with the designation 19 and 19′, although the number of heddles can exceed two as is well known in the art. In passing through the heddles, the warp threads are divided into groups corresponding to the number of heddles. Where the minimum number of two heddles is utilized, the grouping of the warp threads can follow that existing at the leasing zone, although a different grouping is equally permissible as would in any case be necessary if the number of heddles exceeds two. Whatever the number of heddles and the number of warp groups necessitated thereby, the warp threads in the respective heddle groups are interspersed with the threads of all other groups in some predetermined sequence or pattern.

As known in the art, the heddles are reciprocated in a generally vertical direction to and from maximally separated upper and lower positions and as a consequence of this movement, the warp threads engaged by the respective heddles are separated into a more or less diamond shaped three-dimensional "tunnel," referred to as a "shed," and it is into and through the thus-formed shed that a filling thread is projected to effect the weaving operation. The thread groups forming the top and the bottom of the shed are alternately reversed which results in the region of the warp threads proximate the downstream limit of leasing zone 13 alternately changing from positions converging to the downstream lease rod 15, shown in solid lines, to an intersecting position situated downstream of the lease zone limit a distance dependent upon the shedding angle, i.e., the angle separating the warp thread groups when in maximum upper and lower position during shedding, the intersecting position being indicated in dash-dot lines. Downstream of the heddles 19, the warp threads converge again to a common point defined by the fell of the fabric being woven, which is omitted from the schematic showing of FIG. 1 together with the remainder of the loom components, including the filling thread projecting motion because they play no role in the present invention.

In accordance with the present invention, means are provided on one side of the region of the warp array generally within the lease zone, preferably the underside of such array, for generating a current or flow of air directed substantially against the portion of the warp threads within the lease zone. Such a means could take the form of an elongated pipe disposed beneath the lease region in general proximity thereto and having a slit on the upper side of its periphery for emitting a stream of compressed air delivered thereto from any suitable source of compressed air, under the control of timed valving means if desired. However, compressed air is an expensive commodity to produce and supply in considerable volume as would be consumed by a large number of looms within a given weave room or mill, and it is, therefore, preferred to equip the loom with air flow generating means that does not involve the consumption of compressed air. Such a preferred approach is illustrated in FIG. 1 in the form of a fan generally designated 21 and constituted of an elongated hub or shaft 23 extending at least substantially across the entirety of the width of the warp with its axis parallel to a horizontal plane passing through the axes of lease rods 15, 15′ in adjacent somewhat spaced relation to the warp threads within lease zone 13. From hub 23 projects at least one and preferably two or more elongated fan blades 25, the limits of which define a periphery zone in dot-dash lines that at its nearest point falls well clear of the adjacent warp array. The fan 21 is rotatatively driven in any desired way, such as a pulley 27 keyed to hub 23 for rotation therewith and engaged by driving belt 29 or the like driven from the crankshaft of the loom or by a separate motor, not shown.

As fan 21 is rotated, the revolution of its blades 25 generates a flow of air in tangential directions substantially uniformly around the fan blade perimeter and in order to concentrate or focus a segment of this air flow upon the leasing zone of the loom, appropriate guide elements are interposed between the upper segment of the fan blade perimeter and the leasing zone. While the number, extent and inclination of these air guiding elements is, of course, subject to considerable variation, a preferred arrangement appears in FIG. 1 and includes an inclined guide plate 31 extending more or less tangentially from the perimeter of the fan blade beneath the downstream lease rod 15 toward the central section of the lease zone together with a generally vertically arranged baffle plate 33 occupying substantially the full distance between the fan blade perimeter and the crossover point of the lease zone but stopping short at its opposite ends from contact either with the warp or the fan perimeter.

The effect of this combination of guiding and baffle plates is obviously to collect and converge a segment of the air flow generated by the rotation of fan blade 25 and impinge the same against a portion of the warp array within the leasing zone. Since active air flow occurs only during the given segment of the fan blade rotation, the described arrangement results in a pulsating flow of air since no air is impinged against the warp except when the fan blade is moving within this particular segment. Indeed, as the fan blade passes the vertical baffle 33, a region of negative air pressure is created on the side of that plate opposite the inclined guide 31 and opposite the direction of rotation of the fan blade which results in the creation of a flow of air toward the fan perimeter at this point. Thus, with the arrangement of FIG. 2 not only is the air current pulsating in character, it is also bi-directional, first moving towards and against the warp array in the leasing zone and then away from said array towards the fan perimeter so that the warp threads in the region are exposed to what can be considered as an oscillating or reciprocating column of air so as to be subjected to vibration thereby to the extent permitted by the tension existing in the warp threads.

As is apparent from the drawings, the effect of the passage of the warp threads above and below the leasing rods in the leasing zone is to create one or more inflection points in the plane of the warp threads as such threads bend over and around the respective lease rods. Analysis of the hysteresis of the breakage of any tensioned thread leads to the conclusion that as the end of the thread is instantaneously released upon breakage, that end will be propelled in the direction of the tension and will tend to remain in the plane of the tensioned thread. Where inflection points exist in the thread plane, however, the inertial force of the broken end of the thread will inherently result in deviation of the thread from its normal plane in the inflection region and to take advantage of this action, the invention provides photoelectric detecting means disposed adjacent the warp array within the leasing zone on the side of the array opposite the side on which the air current is generated and preferably at locations within the leasing zone where the thread is subjected to maximal tendency to deviate from its normal position upon breakage.

In a preferred embodiment, as shown in FIG. 1, a plurality of photodetecting units are employed with one such unit 35 disposed immediately proximate to the cross-over point 17 of the leasing zone opposite the vertical baffle 33 with two additional units 35' disposed within the convergence of the warp threads on the mutually facing sides of the respective lease rods 15, 15'. Such an arrangement offers a high degree of efficiency in detecting the movement of the broken end of any of the warp yarns.

Figure 2:
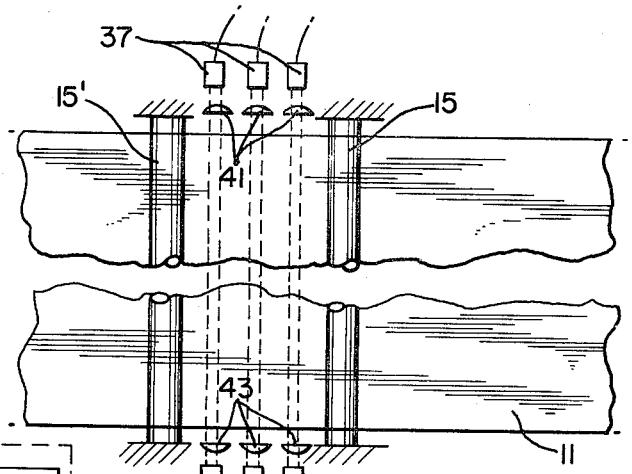
FIG. 2 is a top plan view somewhat enlarged of the leasing zone of the loom included in FIG. 1.

The leasing zone of the loom of FIG. 1 is shown in fragmentary enlarged fashion in FIG. 2 from which it appears that the several photodetection units thereof include photoemitters 37 situated on one side of the warp array (which need not be the same side for each emitter) which are connected to a suitable source of electric power, not shown; while on the opposite side of the warp array, a photoreceiver 39 is provided for each of the photoemitters. Each of the photoemitters emits a beam of light which should be generally columnar in nature and to this end the photoemitters and receivers each are associated with suitable optics suggested by the lenses 41, 43. Preferably, the photoelectric beams are relatively narrow in diameter or transverse dimension for maximum sensitivity and minimum background "noise" but significant latitude is possible in this regard, particularly since the optics 41, 43 can be designed to concentrate the light beam particularly as received by the photoreceivers 39.

Each of the photoreceivers 39 has an output lead 45 which is connected to electronic modulating means generally designated 47 and enclosed within dotted lines. The modulating means is designed to detect the inerception of any photoelectric beam by even a single thread and to provide an amplified output in the form of a control signal which can be delivered to the conventional warp stop motion to activate the same and bring the weaving operation to a stop or, alternately, to indicating means for signalling the occurrence of a discontinuity in a warp thread to the loom attendant or fixer. Preferably, the electronic modulating unit 47 includes means for adjusting the frequency or rate of interception to which the detecting unit is sensitive. As is well known in the art, the leasing region of the loom is susceptible to the presence of lint, fly and the like and, moreover, may be touched or felt by the hand of the loom fixer as a check on the correctness of the loom operating tension and absent a way of adjusting the sensitive frequency of the modulating unit, such extraneous interceptions of the photoelectric beam would result in undesirable activation of the loom stop motion or other indicating device. An adjustable or selective frequency detector 49 can take the form of an adjustable band filter capable of filtering out frequencies below a level corresponding with the rate of movement of a strand of yarn across the light beam and thereby de-sensitizing the unit to extraneous influences. The electronic modulating unit also includes an amplifier 51 for amplifying the output of the photoreceivers to a level compatible with the warp stop motion or other indicating device of the loom.

Figure 3:
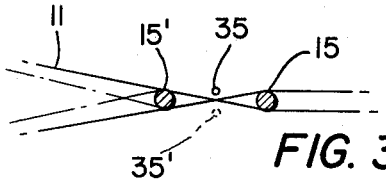
FIGS. 3 and 4 are enlarged side elevational detail views of the leasing zone of FIG. 2 showing modified arrangements of the photoelectric detection unit.
Figure 4:
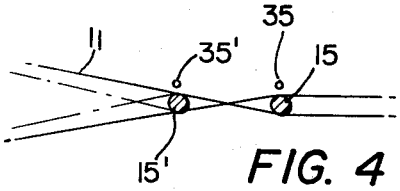

A simplified embodiment of the invention is shown as a modification in FIG. 3 and in this embodiment, a single photoemitter-receiver unit 35' is employed, being situated in close proximity to the cross-over point 17 on the side of the warp array opposite the direction of the air current. Optionally, a second unit 35', shown in dotted lines, can be located on the opposite side of the cross-over point, sufficient clearance therefor being allowed between the cross-over point and the upper extremity of the baffle plate 33, so as to increase the reliability of detection. Another alternative arrangement is seen in FIG. 4 wherein a photodetector unit 35, 35' is disposed approximate to the web array immediately above each of the lease rods 15, 15' on the side opposite the point of origin of the air current.

Figure 5:
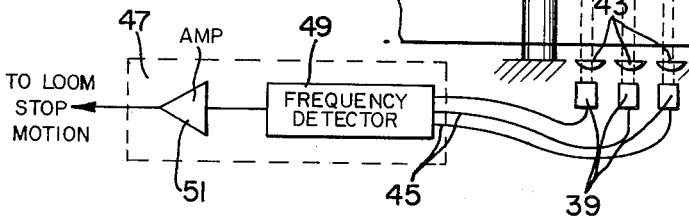
FIG. 5 is an enlarged side elevational detail view of the leasing zone of a loom incorporating a modified form of air current generating means.
Figure 5:
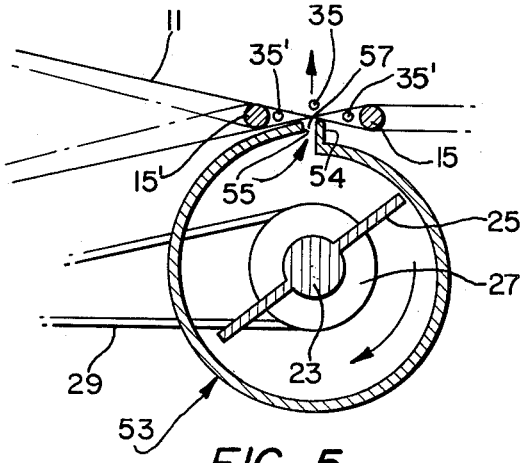

As already mentioned, the type of impeller fan shown in FIG. 1 creates a flow of air generally uniformly around the entire perimeter of the fan which can be undesirable in stirring up the dust, lint and fly that may have settled beneath the loom and thus add to the air borne contamination in the weave room. Furthermore, the exposed blade of the FIG. 1 fan arrangement might be deemed a safety hazard, although this hazzard could easily be reduced or eliminated by enclosing the fan within an openwork cage or screen. To avoid these problems, the fan can be enclosed in a housing 53 such as that illustrated in the modified embodiment of FIG. 5. In this embodiment, the ends of the housing are at least partially or entirely open to permit the in-flow of air therein and the perimeter of the fan is enclosed by a curved wall which preferably corresponds to a so-called Archimedean spiral so as to gradually increase the clearance space between the fan blade perimeter and the inner surface of the housing to permit escape of the air compressed by the fan blade rotation and reduce the resistance or impedance that the housing would otherwise create. The end portion 55 of the spiral-like housing wall corresponds roughly with the inclined guide element 31 and its termination defines one side of an exit slot 57 through which air compressed by the revolving fan blade is delivered against the warp array in the leasing zone, as indicated in broken arrows. The other side of slot 57 is formed by means of a vertical wall section 54 which corresponds essentially to the vertical baffle 33 of the initially described embodiment and closes the increased clearance created by the so-called Archimedean spiral of the housing wall. In this modified embodiment, the flow of air from exit slot 57 obviously cannot be distinctly pulsating in nature as was the flow of air created in the original embodiment inasmuch as the compressive action of the rotating fan blade within the solid walled housing 53 is continuous rather than intermittent and the continuity of the wall prevents the creation of negative pressure on the opposite side of the vertical wall section 54. However, the presence of the vertical wall section 54 at the exit slot of the housing necessarily introduces substantial turbulance into the air passing through such slot, and this turbulance is felt by the warp array proximate thereto as the air more or less tumbles thereacross. This turbulance more or less simulates the effect of the original pulsating air current in dislodging and displacing broken or loosened warp threads for detection by the photodetecting units.

Figure 6:
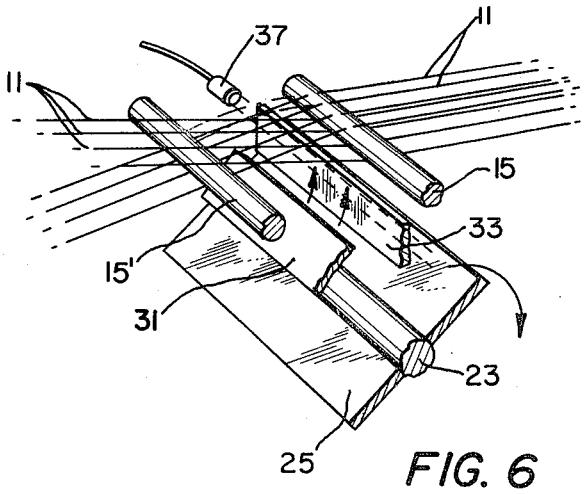
FIG. 6 is a fragmentary positive view of the leasing zone of FIG. 2 in which the position of a relatively loose or broken thread with respect to the photoelectric detecting unit is shown in broken lines.

Thus, with either of the disclosed embodiments, there will be imposed upon the warp threads a tendency towards vibration which tendency will become actual in the event a warp thread is broken or undergoes a significant reduction in tension therein for other reasons. This is illustrated graphically in FIG. 6 wherein it is assumed that the thread most remote from the observer experiences a reduction in tension and is deflected from its normal path in the several positions shown in broken lines in that figure.

While effective electronic units of the type described above could be constructed by any competent electronics engineer, a preferred photoelectric-emitter-receiver unit is commercially available from Opcon, Inc. Everett, Wash., under the model number 8170A-6501. This unit with a light beam of about 0.150" in thickness has been found to function most effectively for purposes of this present invention, with the capability of detecting a single intercepting movement of a single thread. This unit comes equipped with modulating means for adjusting the frequency to which it is sensitive and is especially designed for the detection of movement of textile threads and the like.

If desired, the photoemitter, photoreceiver and the related optics 41, 43 can be selected to emit and receive light of a different frequency from ambient light and thus de-sensitize the system to possible effects of ambient light. The direction of rotation of the fan must obviously be related to the arrangement of the air current guiding elements or housing so that the included element precedes the vertical baffle in the direction of fan rotation. The speed of fan rotation for a fan blade of given dimension is sufficiently high to create an air pressure equal to several inches of water and capable of imposing a perceptible tension by itself upon the threads; for example a double-bladed fan with a blade radius of about 4 inches rotating at 1000 rpm is deemed effective. Instead of a single fan entirely spanning the warp width, two or more shorter fans arranged end to end may be preferable, provided that the full warp is exposed to the collective air current produced thereby. The emitter-receiver elements should be arranged in general alignment but precise alignment is not required due to the compensating effect of the related optics in focusing the light beam to a common locus.

In the course of this description, several distinct embodiments of the invention have already been described, and it will be obvious to the skilled person in this art that other modifications and alterations would be possible within the broad concept of the present invention, and it is intended that all such alterations and modifications are embraced within the broad scope of the invention to the extent permitted by the wording of the appended claims.

What I claim is:

1. In a loom in which warp threads are delivered to a weaving zone in a generally planar array in two interspersed groups via a leasing zone formed by a pair of lease rods with the threads in the respective groups winding over and under said rods to define a warp cross point intermediate said rods, an improved system for detecting loss of tension in individual warp threads due to breakage and the like, which comprises: means for creating a narrow beam of light passing across the warp array in proximity to one of its sides along a locus generally within the limits of said leasing zone, a rotatable fan blade on the other side of said warp array operable when rotated to generate a flow of air directed generally against the portion of the threads within said leasing zone to displace any relatively untensioned warp threads into the path of said light beam to instantaneously intercept said beam converging air flow-guides between said blade and said cross point for directing the air flow from said rotating blade toward said leasing zone, and light beam receiving means for detecting said instantaneous interception of said light beam due to said thread displacement and providing a control signal in response thereto.

2. The loom of claim 1 wherein said air flow directed toward said leasing zone is pulsating.

3. The loom of claim 1 including a stop motion responsive to said control signal for halting weaving in said weaving zone.

4. The loom of claim 1 including means for creating additional beams of light extending along loci up and downstream of said cross point between said lease rods and corresponding receiving means therefor.

5. The loom of claim 1 wherein said light receiving means including means for adjusting the rate of instantaneous interception of said beam to which said receiving means is responsive to provide said control signal.

6. The loom of claim 5 wherein said adjusting means including means for filtering out interceptions in said beam occurring at a rate that does not substantially correspond to the rate of thread displacement by said air flow.

7. The loom of claim 1 wherein said air flow guides include a baffle disposed generally vertically between said blade and a region of said thread array within said leasing zone whereby air flow in opposite directions is generated on opposite sides of said baffle by said fan blade.

8. The loom of claim 7 wherein the plane of said baffle passes generally through said cross point.

* * * * *